US006776507B2

(12) United States Patent
Chen

(10) Patent No.: US 6,776,507 B2
(45) Date of Patent: Aug. 17, 2004

(54) DECORATIVE TABLE LAMP

(75) Inventor: Shang-Chih Chen, Taipei Hsien (TW)

(73) Assignee: Ying Zhu Co., Ltd., Changhua (TW)

( * ) Notice: Subject to any disclaimer, the term of this patent is extended or adjusted under 35 U.S.C. 154(b) by 34 days.

(21) Appl. No.: 10/186,621

(22) Filed: Jul. 2, 2002

(65) Prior Publication Data

US 2004/0004838 A1 Jan. 8, 2004

(51) Int. Cl.[7] ..... F21S 13/14

(52) U.S. Cl. ..... 362/252; 362/800; 362/412; 362/414; 362/250; 362/806

(58) Field of Search ..... 362/252, 412, 362/414, 250, 800, 806, 410, 411, 413, 240

(56) References Cited

U.S. PATENT DOCUMENTS

| | | | | | |
|---|---|---|---|---|---|
| 1,510,130 | A | * | 9/1924 | Aronson | 362/414 |
| 2,277,611 | A | * | 3/1942 | Schaaf | 362/412 |
| 4,495,443 | A | * | 1/1985 | Cummings | 315/58 |
| 2003/0012025 | A1 | * | 1/2003 | Christen | 362/362 |

* cited by examiner

*Primary Examiner*—Stephen Husar
*Assistant Examiner*—James Cranson
(74) *Attorney, Agent, or Firm*—Browdy and Neimark, P.L.L.C.

(57) ABSTRACT

The present invention provides a decorative table lamp. The table lamp may include a base of the lamp. The base contains in its lower portion power supplying cords and a cylindrical container in an upper portion of the base. The table lamp also includes two or more rod-shaped illuminating devices placed within and preferably extending out from the cylindrical container. The rod-shaped illuminating devices are conductively coupled to the power supplying cords.

8 Claims, 7 Drawing Sheets

DECORATIVE TABLE LAMP

FIELD OF THE INVENTION

The present invention relates to a table lamp, and more specifically, to a decorative table lamp.

BACKGROUND OF THE INVENTION

A majority of table lamps in the marketplace today are provided for the major purpose of illumination, such as a reading light, bed-end light, or to light up a reading room, family room, or living room. Although some table lamps have decorative illumination as their secondary functions, most of these table lamps exist for the major purpose of illumination rather than decoration. With the improving life quality and standards the increasing demands thereof, the importance of decorative lightings within families, office, restaurant, bars, and other private and public places increases over time. In some settings, the decorative purpose of lamps becomes the major goal of their existence. Therefore, to achieve this goal, the marketplace needs a decorative table lamp that can be employed in various settings.

SUMMARY OF THE INVENTION

The present invention provides a decorative table lamp. The table lamp may include a base of the lamp. The base contains in its lower portion power supplying cords and a cylindrical container in an upper portion of the base. The table lamp also includes two or more rod-shaped illuminating devices placed within and preferably extending out from the cylindrical container. The rod-shaped illuminating devices are conductively coupled to the power supplying cords.

BRIEF DESCRIPTION OF THE DRAWINGS

The foregoing aspects and many of the attendant advantages of this invention will become more readily appreciated and better understood by referencing the following detailed description, when taken in conjunction with the accompanying drawings, wherein.

DETAILED DESCRIPTION OF THE PREFERRED EMBODIMENT

Figure 1:
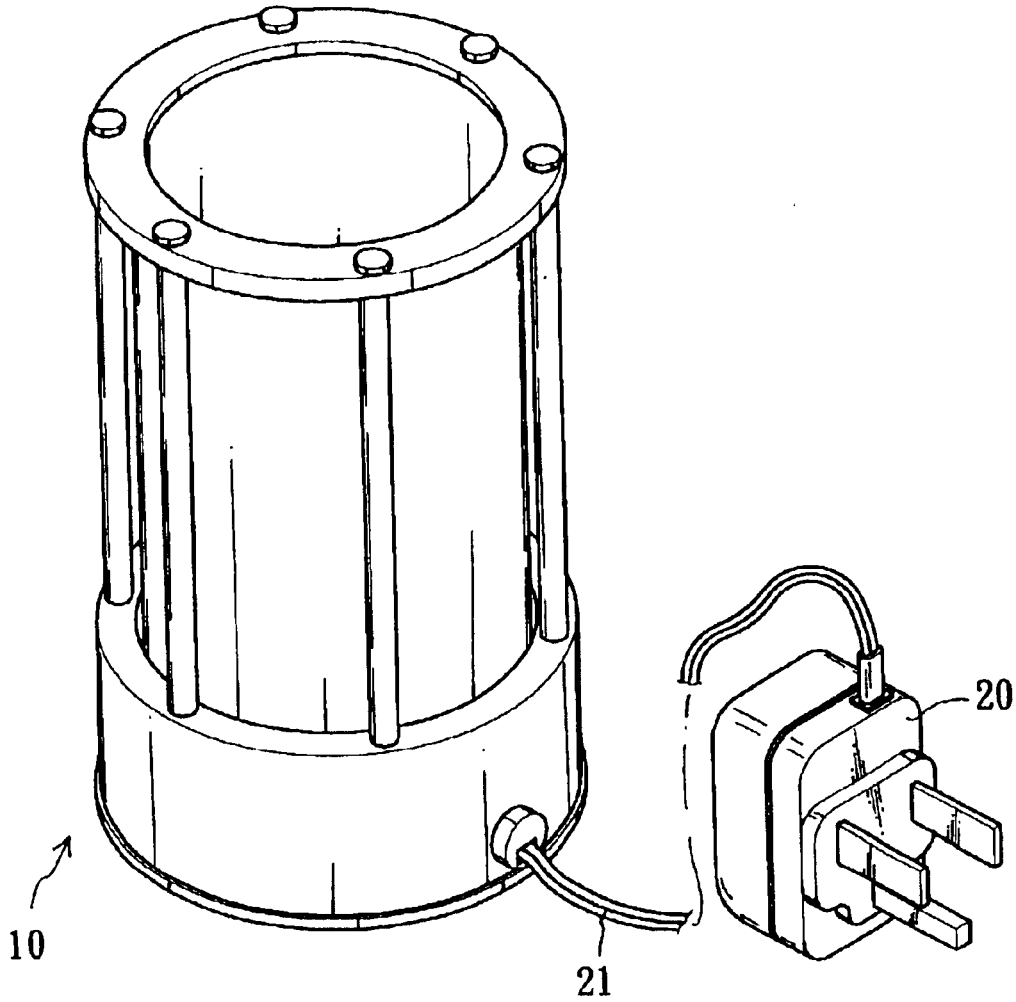
FIG. 1 illustrates a perspective view of the base of the table lamp of the present invention.

The present invention provides a decorative table lamp. Referring to FIG. 1, the table lamp has a base 10 containing power supplying cords 21 that are preferably connected to a power supply 20. The power supply 20 may be a low-voltage DC power source, such as an AC-DC adaptor or a combination of a power transformer and converter.

Figure 2:
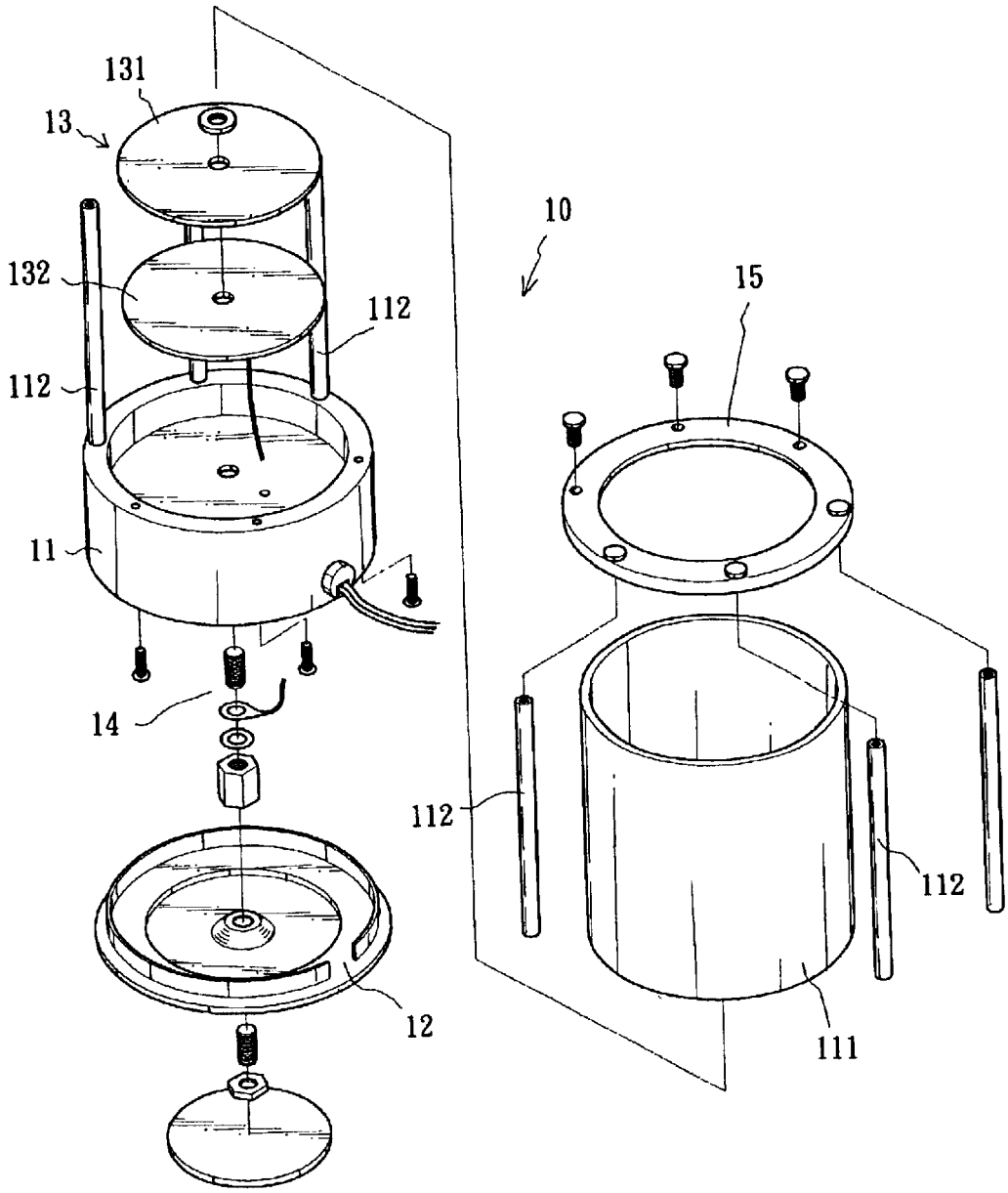
FIG. 2 is an exploded view illustrating the structure and parts inside the base of the table lamp of the present invention.

Referring to FIG. 2, the base 10 provides a lower portion 11 and, above the bottom portion 11, a cylindrical container in the upper portion. The cylindrical container has a sidewall portion 111. The cylindrical container may be made of transparent, semi-transparent, or opaque materials to allow light-emitting device to be placed inside and demonstrate different lighting effects. The base 10 comprises a sandwiched structure that has a bottom insulating layer 12, the power supplying cords 21 may run through the bottom portion and the sandwiched structure to conductively couple with a first conductive layer 131 and a second conductive layer 132, with each conductive layer being conductively coupled to a different pole. Locating above and spacing apart from the bottom insulating layer 12, the first conductive layer 131 and the second conductive layer 132 are insulated from each other.

Figure 3:
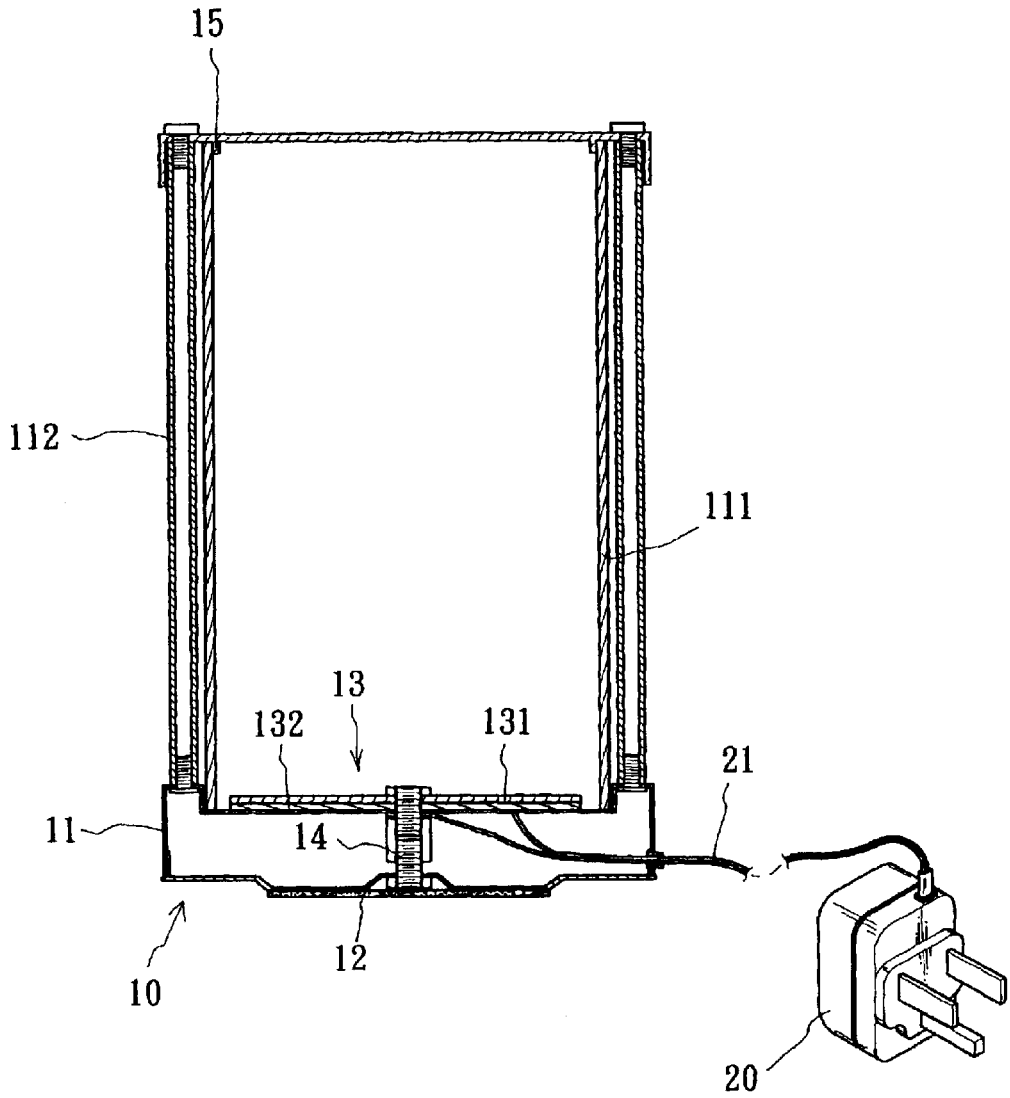
FIG. 3 illustrates a sectional view of the base of the table lamp of the present invention.

Referring to FIG. 2 and FIG. 3, the second conductive layer 132 may be conductively coupled to the sidewall portion 111 of the cylindrical container, or to two or more conductive columns 112 that extend longitudinally along the cylindrical container. To provide support for the first conductive layer 131 and the second conductive layer 132 and increase the strength of the structure, a supporting rod 14 may be provided.

Figure 5:
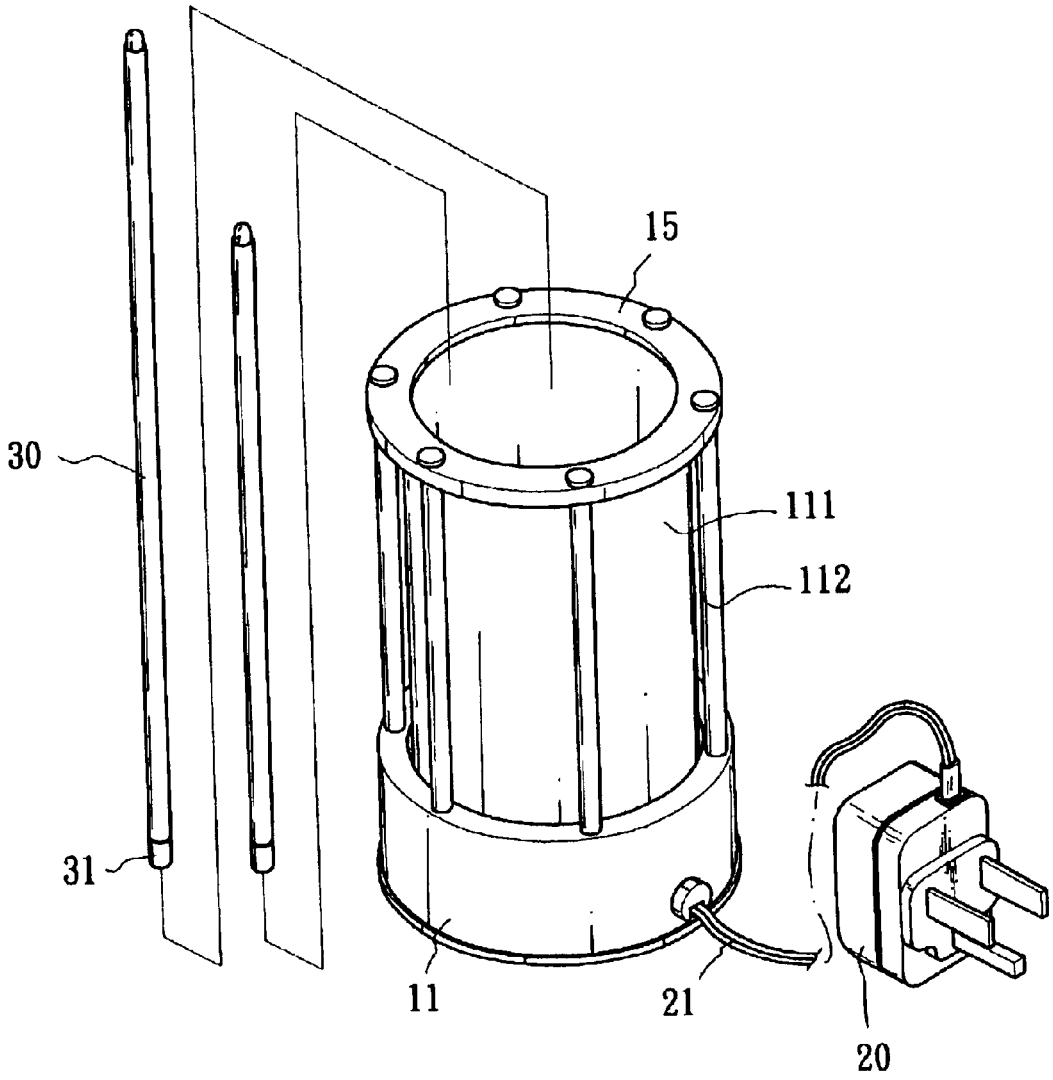
FIG. 5 illustrates a perspective view of the base and the rod-shaped illuminating device of the table lamp of the present invention.

Referring to FIG. 5, two or more rod-shaped illuminating devices are provided for the table lamp of the present invention. The rod-shaped illuminating devices can be placed within and also extended out from the cylindrical container. When the table lamp is in use, the rod-shaped illuminating devices may be placed on to the first conductive layer 131 and be conductively coupled with the first conductive layer 131 by their base ends. The rod-shaped illuminating devices, as shown in FIG. 5, each has a longitudinally extended, slim rod shape. In the preferred embodiments, the rod-shaped illuminating devices are longer than the vertical depth of cylindrical container.

Referring to FIG. 5, the rod-shaped illuminating device each has an conductive base end 31 and a conductive tube wrap 30 wrapping around part of the sidewall portion of each rod-shaped illuminating device. The conductive base end 31 and the conductive tube wrap 30 of each rod-shaped illuminating device are electrically insulated from each other. In one embodiment, the conductive base ends 31 are in conductive contact with the first conductive layer 131 and the conductive tube wrap 30 are in conductive contact with an conductive cylindrical edge 15 of the cylindrical container. As illustrated in FIGS. 2, 3 and 5, the conductive cylindrical edge 15 may be conductively coupled with the second conductive layer 132 through the sidewall 111 or the conductive columns 112. Each rod-shaped illuminating device may contain light-emitting diode or diodes at it end or be installed with other types of low-voltage emitting devices.

As illustrated in FIG. 1, separating the power supply 20 from the base 10 of the table lamp may provide improved safety. Alternatively, the power supply may be installed within the base 10 and power supplying cords may be used to connect the power supply with an AC power source. As discussed above, the two poles provided by the power supply 20 through power supplying cords 21 are conductively coupled with the first and second conductive layers.

Figure 6:
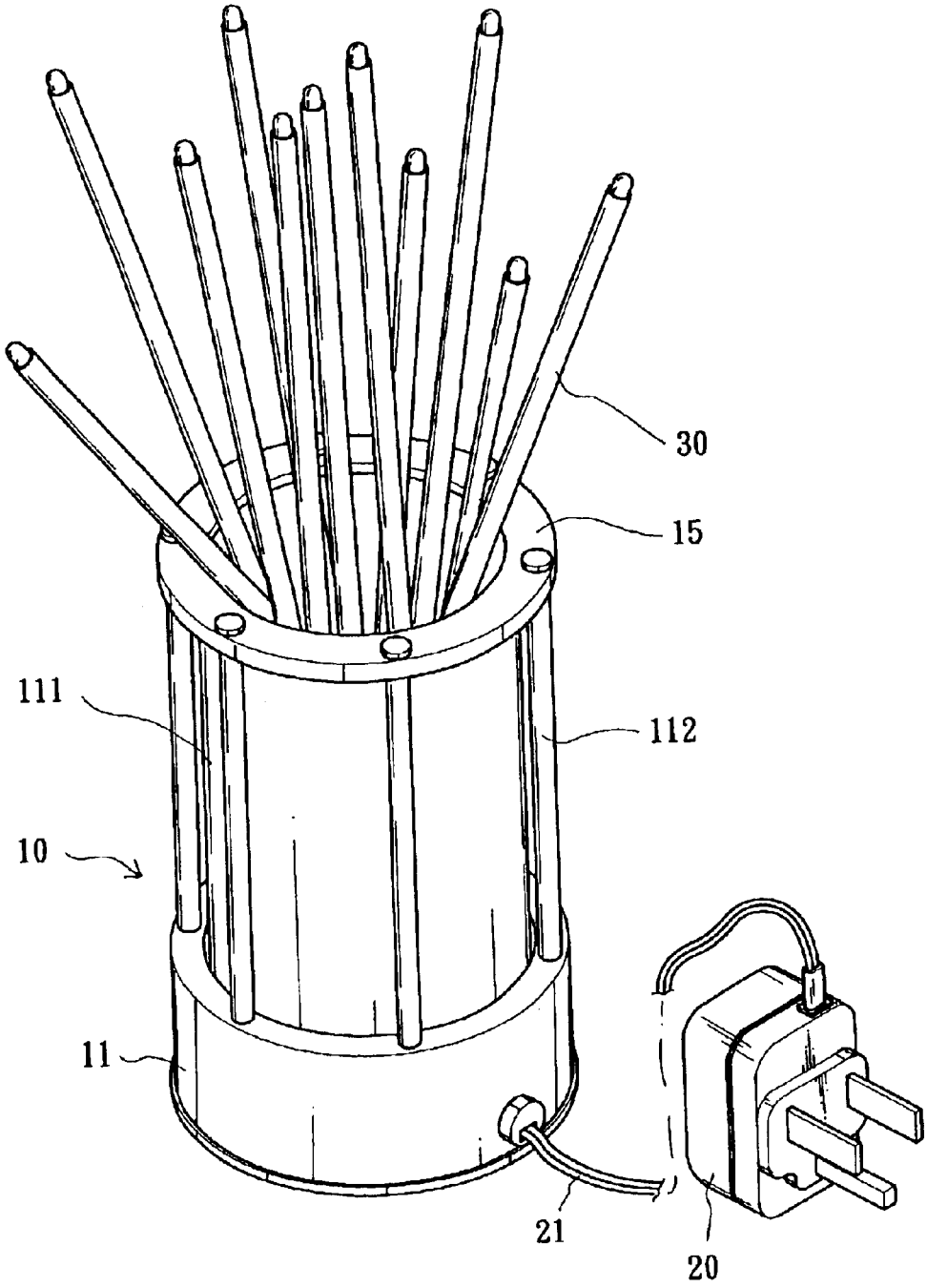
FIG. 6 illustrates a perspective view of the table lamp of the present invention.
Figure 7:
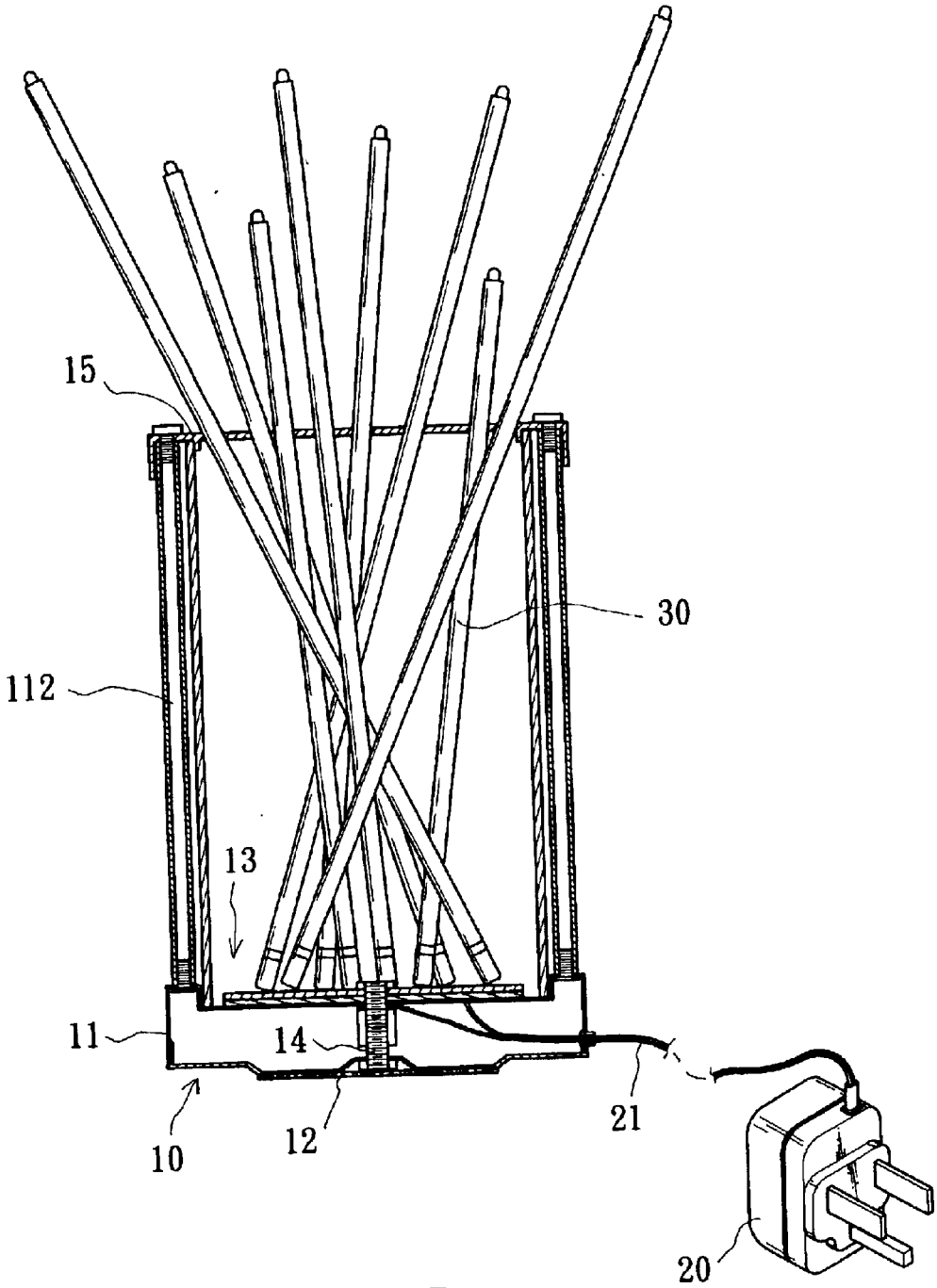
FIG. 7 illustrates a sectional view of the table lamp of the present invention.

By randomly placing the rod-shaped illuminating devices in the cylindrical container as shown in FIG. 6, the conductive base ends of the rod-shaped illuminating devices are in direct and conductive contact with the first conductive layer 131 located in the bottom of the cylindrical container, and the conductive tube wrap 30 of some of the rod-shaped illuminating devices are in direct and conductive contact with the conductive cylindrical edge 15 of the cylindrical container. When there are more rod-shaped illuminating devices in the cylindrical container, the conductive tube wrap 30 of some of the rod-shaped illuminating devices may not have direct contact with the conductive cylindrical edge 15. However, because the conductive tube wrap 30 of one rod-shaped illuminating device are always in direct contact with the conductive tube wrap 30 of one or more other rod-shaped illuminating devices, the conductive tube wraps themselves form a conductive loop that make all the conductive tube wraps coupled together conductively. This conductive loop allows the conductive tube wrap 30 of all the rod-shaped illuminating devices to have all-time conductive contact with the conductive cylindrical edge 15 no matter how each rod-shaped illuminating device is placed in the cylindrical container. As a result, the users of the table lamp may arrange the rod-shaped illuminating devices in any way they prefer and keep all rod-shaped illuminating devices lighted up.

As illustrated in FIG. 6, the rod-shaped illuminating devices may be provided with different lengths to provide more variations or randomness of the pattern. Further, because transparent, semi-transparent, or opaque sidewalls 111 may be used, the combined effects of the randomly or intentionally arranged pattern of the rod-shaped illuminating devices provides an special or unusual lighting or decorating experiences, especially at night or in dark areas. The users may also use the table lamp of the present invention in combination with the traditional illuminating devices to achieve both decorative and illuminating goals.

Figure 4:
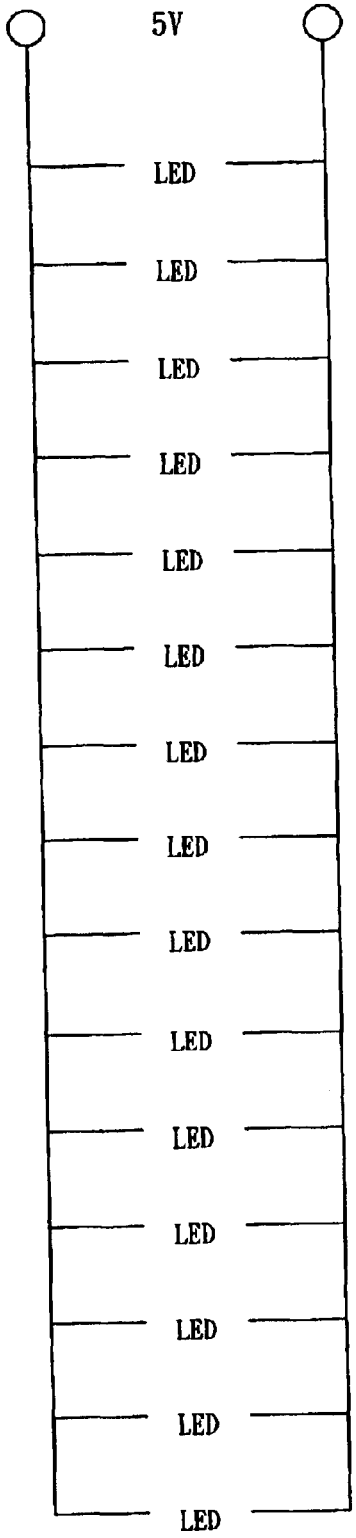
FIG. 4 illustrates the electric circuit of one embodiment for the rod-shaped illuminating device of the present invention.

Further, by using a low-voltage power for the rod-shaped illuminating devices, such as a 24 volt, 12 volt, or a lower voltage power supply, the table lamp of the present invention provides increased safety and allows the use of batter power. As an example, the rod-shaped illuminating devices may use light-emitting diode or diodes (LEDs) or other low-voltage illuminating cells as the light source. FIG. 4 illustrates an example of the schematic electric circuit of one LED circuit for a rod-shaped illuminating device. The design significantly eliminates the safe concern of the table lamp.

As is understood by a person skilled in the art, the foregoing descriptions of the preferred embodiment of the present invention are an illustration of the present invention rather than a limitation thereon. It is intended to cover various modifications and similar arrangements included within the spirit and scope of the appended claims. The scope of the claims should be accorded to the broadest interpretation so as to encompass all such modifications and similar structures. While the preferred embodiment of the invention has been illustrated and described, it will be appreciated that various changes can be made therein without departing from the spirit and scope of the invention.

What is claimed is:

1. A decorative table lamp, comprising a base containing in its lower portion power supplying cords and a cylindrical container in an upper portion of the base; and at least two rod-shaped illuminating devices within and extending from the cylindrical container, the rod-shaped illuminating devices being connected with the power supplying cords;

wherein the base portion comprises a sandwiched structure having a bottom insulating layer, a first conductive and a second conduct layer above the bottom insulating layer, the first and second conductive layer being insulated from each other and each being conductively coupled to one pole of the power supplying cords.

2. The decorative table lamp of claim 1, wherein the second conductive layer is conductively coupled to the sidewall of the cylindrical container or conductive columns extended longitudinally along the cylindrical container.

3. The decorative table lamp of claim 1, wherein the sandwiched structure has a supporting rod for supporting the first an second conductive layers.

4. The decorative table lamp of claim 1, wherein the rod-shaped illuminating devices are placed inside the cylindrical container and bottoms of the rod-shaped illuminating devices are conductively coupled with the first conductive layer.

5. The decorative table lamp of claim 4, wherein the rod-shaped illuminating devices each has a longitudinally extended slim rod shape, the rod-shaped illuminating devices being longer than the depth of the cylindrical container.

6. The decorative table lamp of claim 4, wherein the rod-shaped illuminating devices each has an conductive base end and a conductive tube wrap, the conductive base end being in conductive contact with the first conductive layer and the conductive tube wrap being in conductive contact with an conductive cylindrical edge of the cylindrical container, the conductive cylindrical edge being conductively coupled with the second conductive layer through the sidewall or the conductive columns.

7. The decorative table lamp of claim 4, wherein the rod-shape illuminating devices are randomly placed in the cylindrical container.

8. The decorative table lamp of claim 4, wherein the rod-shaped illuminating devices contain light emitting diodes.

* * * * *